US008152483B2

(12) United States Patent
Kawamura et al.

(10) Patent No.: US 8,152,483 B2
(45) Date of Patent: Apr. 10, 2012

(54) VARIABLE CAPACITY COMPRESSOR

(75) Inventors: Makoto Kawamura, Ashikaga (JP); Masakazu Aoki, Ashikaga (JP)

(73) Assignee: Calsonic Kansei Corporation, Saitama-shi (JP)

( * ) Notice: Subject to any disclaimer, the term of this patent is extended or adjusted under 35 U.S.C. 154(b) by 718 days.

(21) Appl. No.: 12/296,206

(22) PCT Filed: Apr. 5, 2007

(86) PCT No.: PCT/JP2007/057657

§ 371 (c)(1),
(2), (4) Date: Dec. 2, 2008

(87) PCT Pub. No.: WO2007/116936

PCT Pub. Date: Oct. 18, 2007

(65) Prior Publication Data

US 2009/0178552 A1 Jul. 16, 2009

(30) Foreign Application Priority Data

Apr. 7, 2006 (JP) ..... P2006-106520

(51) Int. Cl.
*F04B 1/12* (2006.01)
*F04B 27/08* (2006.01)

(52) U.S. Cl. ..... 417/269; 91/505

(58) Field of Classification Search ..... 417/269; 91/505

See application file for complete search history.

(56) References Cited

U.S. PATENT DOCUMENTS

| | | | | |
|---|---|---|---|---|
| 4,425,837 | A * | 1/1984 | Livesay | 92/71 |
| 4,674,957 | A * | 6/1987 | Ohta et al. | 417/222.2 |
| 5,762,476 | A * | 6/1998 | Ota et al. | 417/222.2 |
| 5,947,002 | A | 9/1999 | Eitai et al. | |
| 6,139,282 | A * | 10/2000 | Ota et al. | 417/222.2 |
| 6,553,890 | B2 * | 4/2003 | Ahn | 92/12.2 |
| 6,572,342 | B2 * | 6/2003 | Ahn et al. | 417/222.1 |
| 6,782,798 | B2 | 8/2004 | Ahn | |
| 2005/0186086 | A1 * | 8/2005 | Ota et al. | 417/269 |

(Continued)

FOREIGN PATENT DOCUMENTS

EP 0 945 616 B1 9/1999

(Continued)

OTHER PUBLICATIONS

Japanese Office Action and English Translation, dated Aug. 16, 2011, 4 pages.

*Primary Examiner* — Devon C Kramer
*Assistant Examiner* — Ryan Gatzemeyer
(74) *Attorney, Agent, or Firm* — Foley & Lardner LLP

(57) ABSTRACT

The variable capacity compressor has a rotor 21, as a rotating member, fixed to a drive shaft 10 and rotating integrally with the drive shaft 10, a swash plate 24, as a tilting member, tiltably and slidably attached to the drive shaft 10, a linkage mechanism 40 linking the rotor 21 and the swash plate 24 at a position corresponding to an upper dead center of the swash plate 24, transferring rotation of the rotor 21 to the swash plate 24, and guiding the tilting movement of the swash plate 24, and a tilting movement guide 60 provided between the rotor 21 and the swash plate 24 and anterior to the linkage mechanism 40 in the rotating direction and guiding changes of the inclination angle of the swash plate 24 with respect to the drive shaft 10.

12 Claims, 17 Drawing Sheets

U.S. PATENT DOCUMENTS

2007/0220859 A1 * 9/2007 Kubo et al. ..... 60/226.3

FOREIGN PATENT DOCUMENTS

| | | | |
|---|---|---|---|
| EP | 945616 | A2 * | 9/1999 |
| EP | 1 275 846 | B1 | 1/2003 |
| JP | 10-176658 | A | 6/1998 |
| JP | 11-280645 | A | 10/1999 |
| JP | 2002-048056 | A | 2/2002 |
| JP | 2003-021055 | A | 1/2003 |
| JP | 2003-172417 | A | 6/2003 |
| JP | 2003-193966 | A | 7/2003 |
| JP | 2004-068756 | A | 3/2004 |
| JP | 2005-240593 | A | 9/2005 |
| WO | WO 2005-100790 | A1 | 10/2005 |

* cited by examiner

VARIABLE CAPACITY COMPRESSOR

TECHNICAL FIELD

The present invention relates to a variable capacity compressor.

BACKGROUND ART

A variable capacity compressor has a drive shaft, a rotor fixed to the drive shaft and rotating integrally with the drive shaft, a swash plate slidably attached to the drive shaft, and a linkage mechanism provided between the rotor and the swash plate and guiding changes of inclination angle of the swash plate while transferring rotary torque from the rotor to the swash plate. The variable capacity compressor is capable of changing inclination angle of the swash plate to change piston strokes so that discharging amount can be controlled.

Japanese Patent Application Laid-Open No. 2004-068756 discloses a linkage mechanism of a variable capacity compressor. The linkage mechanism has a projection extending from a rotor toward a swash plate, a projection extending from the swash plate toward the rotor and overlapping with the projection of the rotor in a rotating direction, and a guide face provided on a base portion of the projection of the rotor. The guide face slidably guides a fore-end of the projection of the swash plate to guide changes of the inclination angle of the swash plate and receive axial direction load applied to the swash plate. The projection of the rotor is formed in a forked shape with a slit in which the projection of the swash plate is inserted and sandwiched. With this configuration, the projection of the rotor and the projection of the swash plate are overlapped with each other in the rotating direction and the rotation of the rotor is transferred to the swash plate.

A linkage mechanism of a variable capacity compressor disclosed in Japanese Patent Application Laid-Open No. 2003-172417 has an arm extending from a rotor toward a swash plate, an arm extending from the swash plate toward the rotor, an intermediate link overlapped with those arms in a rotating direction, a hinge pin linking the arm of the rotor and the intermediate link, and a hinge pin linking the arm of swash plate and the intermediate link. In this linkage mechanism, the intermediate link, the rotor and the swash plate are overlapped one another in a rotating direction in a sandwich structure. With this configuration, rotary torque of the rotor is transferred to the swash plate, and the axial direction load of the pistons applied to the swash plate is received by the hinge pins.

A linkage mechanism of a compressor disclosed in Japanese Patent Application Laid-Open No. 10-176658 has a similar configuration to the linkage mechanism of Japanese Patent Application Laid-Open No. 2003-172417.

DISCLOSURE OF THE INVENTION

FIGS. 16 to 18 show a linkage mechanism of a variable capacity compressor similar to that of Japanese Patent Application Laid-Open No. 2004-068756. The linkage mechanism of the variable capacity compressor has an arm 104 extending from a rotor 103 toward a swash plate 101, an arm 102 extending from the swash plate 101 toward the rotor 103, and a guide face 105 provided on a base portion of the arm 104 of the rotor. The guide face 105 slidably guides an fore-end of the arm 102 of the swash plate to guide changes of the inclination angle of the swash plate and receive compression reaction force (axial direction load) Fp of pistons applied to the swash plate 101. The arm 104 of the rotor is formed in a forked shape with a slit 106 in which the arm 102 of the swash plate is inserted and sandwiched, as shown in FIG. 17. With this configuration, the arm 104 of the rotor and the arm 102 of the swash plate are overlapped in a rotating direction R and the rotation of the rotor 103 is transferred to the swash plate 101.

In this case, compression reaction force Fp applied from the plural pistons to the swash plate 101 is not symmetrically applied to a line C along the upper dead center TDC and lower dead center BDC of the swash plate 101 (see FIG. 17, 18) and the maximum compression reaction force Fp is applied an area slightly anterior to the upper dead center in the rotating direction R. The swash plate 101 thus receives the maximum compression reaction force Fp at the area anterior to the upper dead center TDC in the rotating direction R. As a result, torsion moment is applied to the swash plate 101. The reason why the maximum compression reaction force Fp is applied to the area slightly anterior to the upper dead center TDC in the rotating direction R is that compression reaction force received by each piston is maximized just before the upper dead center (that is, an end of compression strokes) of each piston and, at this timing, compressed refrigerant is discharged.

In this conventional art, as shown in FIGS. 16 to 18, when torsion moment due to the compression reaction force Fp is applied, the swash plate 101 is tilted with respect to the line C along the upper dead center TDC and lower dead center BDC as shown in FIG. 18 so that two corners K, K of the arm 102 of the swash plate 101 are excessively pressed into inner surfaces of the arm 104 of the rotor 103, because the arm 102 of the swash plate 101 is sandwiched by the arm 104 of the rotor 103. In other words, the arm 103 become to wedged in the slit 106. Such a wedge state causes an excessive sliding friction when the inclination angle of the swash plate 101 is changed and the inclination angle of the swash plate 101 cannot be smoothly changed. Further, the excessive sliding friction may shorten the life of the linkage mechanism.

The present invention has an object to provide a variable capacity compressor having a linkage mechanism in which a sandwich structure transfers rotation and guides the inclination angle of a swash plate, wherein the variable capacity compressor capable of making a wedge state harder to occur.

An aspect of the present invention is a variable capacity compressor has a rotating member fixed to a drive shaft and rotating integrally with the drive shaft; a tilting member tiltably attached to the drive shaft; a linkage mechanism linking the rotating member and the tilting member at a position corresponding to an upper dead center of the tilting member, and having a sandwich structure along a rotating direction to transfer rotation of the rotating member to the tilting member and guide the tilting movement of the tilting member; and a tilting movement guide provided between the rotating member and the tilting member and anterior to the linkage mechanism in the rotating direction and guiding changes of the inclination angle of the tilting member with respect to the drive shaft.

According to the aspect of the present invention, the tilting movement guide provided anterior to the linkage mechanism in the rotating direction can receive axial direction load applied to the tilting member. In other words, the tilting movement guide can receive compression reaction force even when compression reaction force is applied to an area biased anterior to linkage mechanism, which is placed corresponding to the upper dead center, in the rotating direction. This configuration works to reduce the torsion moment applied to the linkage mechanism and prevent a wedge state in the linkage mechanism due to an excessive pressure. Thus the inclination angle of the tilting member can be smoothly changed and controllability is improved. Further, longer operating life of the linkage mechanism can be obtained.

Preferably, the tilting movement guide is provided closer to a lower dead center of the tilting member than the linkage mechanism, wherein the lower dead center is disposed on the opposite side of the linkage mechanism across the drive shaft.

In this configuration, since barycenter which tends to be closer to the upper dead center can be shifted on the lower dead center side, the balance of the rotor and swash plate is improved.

Preferably, the tilting movement guide is placed substantially intermediate between the upper dead center and the lower dead center in the rotating direction. This configuration provides an improved weight balance.

Preferably, the tilting movement guide is contact portions respectively formed at the rotating member and the tilting member and contact with each other. This configuration provides a tilting movement guide having a simpler structure.

Preferably, the variable capacity compressor further includes a rotation transfer support provided between the rotating member and the tilting member and transferring rotation of the rotating member to the tilting member. This configuration provides a smaller rotary torque transferred in the linkage mechanism. In this configuration, the inclination angle of the tilting member can be smoothly changed and the controllability is improved. Further, this provides a longer operation life of the linkage mechanism.

Preferably, the variable capacity compressor further includes a rotation transfer support provided between the rotating member and the tilting member and posterior to the linkage mechanism in a rotating direction, and guiding changes of inclination angle of the tilting member. In this configuration, the rotation transfer support is provided between the rotating member and tilting member and posterior to the linkage mechanism in the rotating direction to guide changes of the inclination angle of the tilting member. Thus the rotation transfer support also has a function for transferring the rotation of the rotating member to the tilting member. This reduces a rotary torque transferred by the linkage mechanism. Further, since the tilting movement guide is provided anterior to the linkage mechanism in the rotating direction and the rotation transfer support is provided posterior to the linkage mechanism in the rotating direction, the weight balance of the rotating member and tilting member is further improved. In addition, the tilting movement guide, linkage mechanism, and rotation transfer support are placed to form a triangle around the drive shaft. Since the tilting member can be supported against the rotating member at those three positions of the tilting movement guide, linkage mechanism and rotation transfer support, so that the tilting member is steadily supported.

Preferably, the rotation transfer support is placed substantially intermediate between the upper dead center and the lower dead center in the rotating direction. This configuration provides a well weight-balanced rotating member and tilting member.

Preferably, the tilting movement guide and the rotation transfer support are placed opposite to each other across the drive shaft. This configuration provides a well weight-balanced rotating member and tilting member.

Preferably, the tilting movement guide and the rotation transfer support are formed in a mirror symmetry manner across with respect to a plane passing through the drive shaft. This configuration provides well weight-balanced rotating member and tilting member. Further, since the tilting movement guide and the rotation transfer support are formed in symmetric shapes, manufacturing process can be simplified.

Preferably, the rotation transfer support is contact portions respectively formed at the rotating member and the tilting member and contact with each other. This configuration provides a rotation transfer support having a simple structure.

The linkage mechanism may include an arm extending from the rotating member toward the tilting member, an arm extending from the tilting member toward the rotating member, an intermediate link overlapping with the arms in a rotating direction, a first hinge pin linking the arm of the rotating member and the intermediate link, and a second hinge pin linking the arm of the tilting member and the intermediate link, wherein the intermediate link and the rotating member or the tilting member is overlapped in the rotating direction in the sandwich structure along the rotating direction. This configuration provides a simpler linkage mechanism having a sandwich structure.

The linkage mechanism may include an arm extending from the rotating member toward the tilting member and formed in a forked shape with a slit, an arm extending from the tilting member toward the rotating member and formed in a forked shape with a slit, an intermediate link inserted into the slits of those arms to be overlapped with the arms in the rotating direction, a first hinge pin linking the arm of the rotating member and the intermediate link, and a second hinge pin linking the arm of the tilting member and the intermediate link. This configuration provides a simpler linkage mechanism having a sandwich structure.

The linkage mechanism may include an arm extending from the rotating member toward the tilting member, an arm extending from the tilting member toward the rotating member and overlapping with the arm of the rotating member in the rotating direction, an arch-shaped long hole formed at one of the arms, and a pin fixed to the other of the arms and inserted into the long hole, wherein the arm of the rotating member is formed in a forked shape with a slit to slidably sandwich the arm of the tilting member, or the arm of the tilting member is formed in a forked shape with a slit to slidably sandwich the arm of the rotating member. This configuration provides a simpler linkage mechanism having a sandwich structure.

The linkage mechanism may include an arm extending from the rotating member toward the tilting member, an arm extending from the tilting member toward the rotating member, and a tilting movement guide face, wherein the arm of the rotating member is formed in a forked shape with a slit to slidably sandwich the arm of the tilting member or the arm of the tilting member is formed in a forked shape with a slit to slidably sandwich the arm of the rotating member so that the arm of the rotating member and the arm of the tilting member are overlapped in the rotating direction, and wherein the tilting movement guide face is formed at a base portion of the arm of the rotating member or the arm of the tilting member and contacts with a fore-end of the arm of the tilting member or the arm of the rotating member to receive axial direction load applied to the tilting member and guide changes of inclination angle of the tilting member with respect to the drive shaft. This configuration provides a simpler linkage mechanism having a sandwich structure.

BEST MODE FOR CARRYING OUT THE INVENTION

A variable capacity compressor according to an embodiment of the present invention will be described with reference to the drawings.

Figure 1:
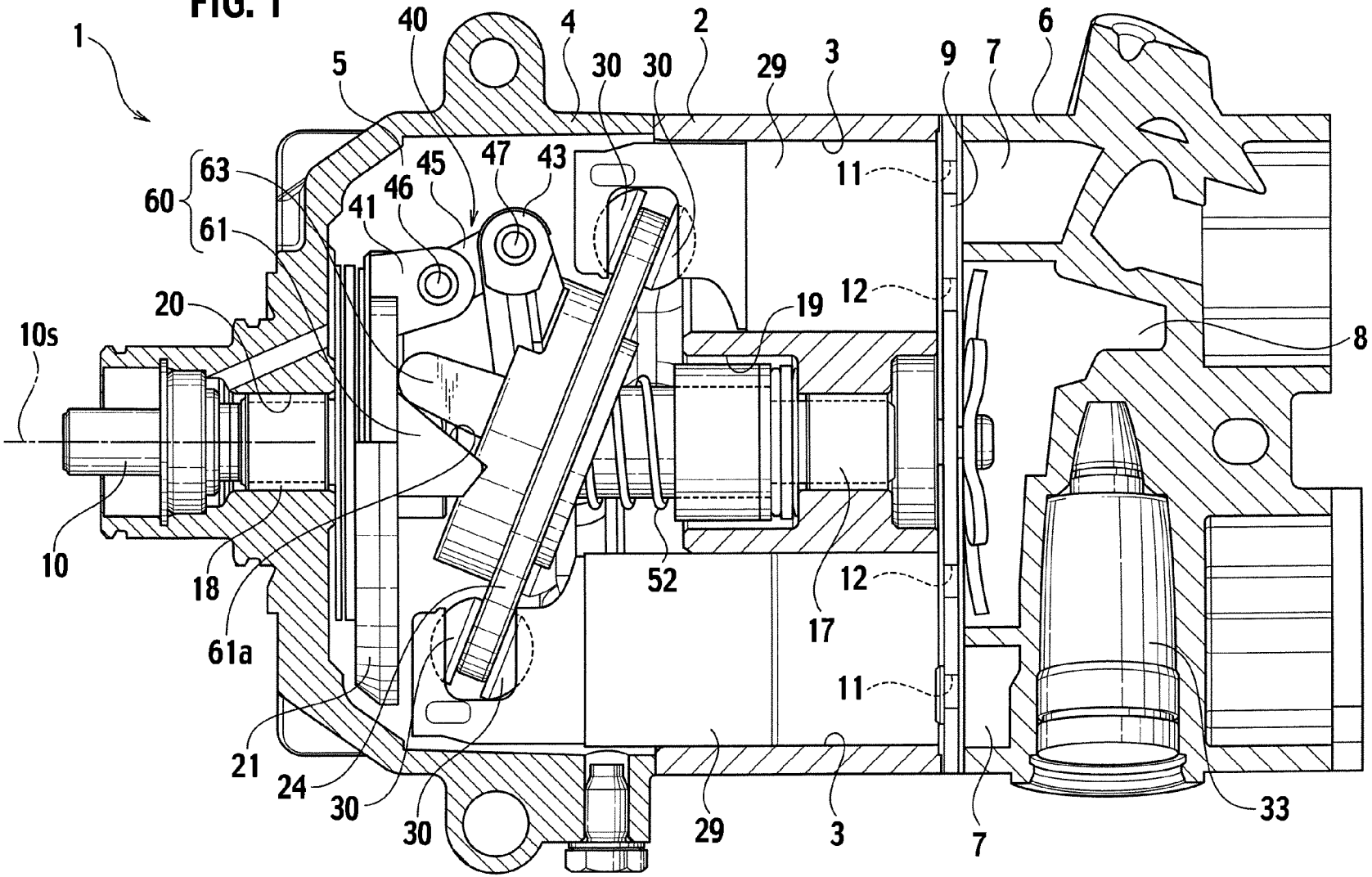
FIG. 1 is an overall view showing a variable capacity compressor with cross sections according to an embodiment of the present invention.
Figure 2:
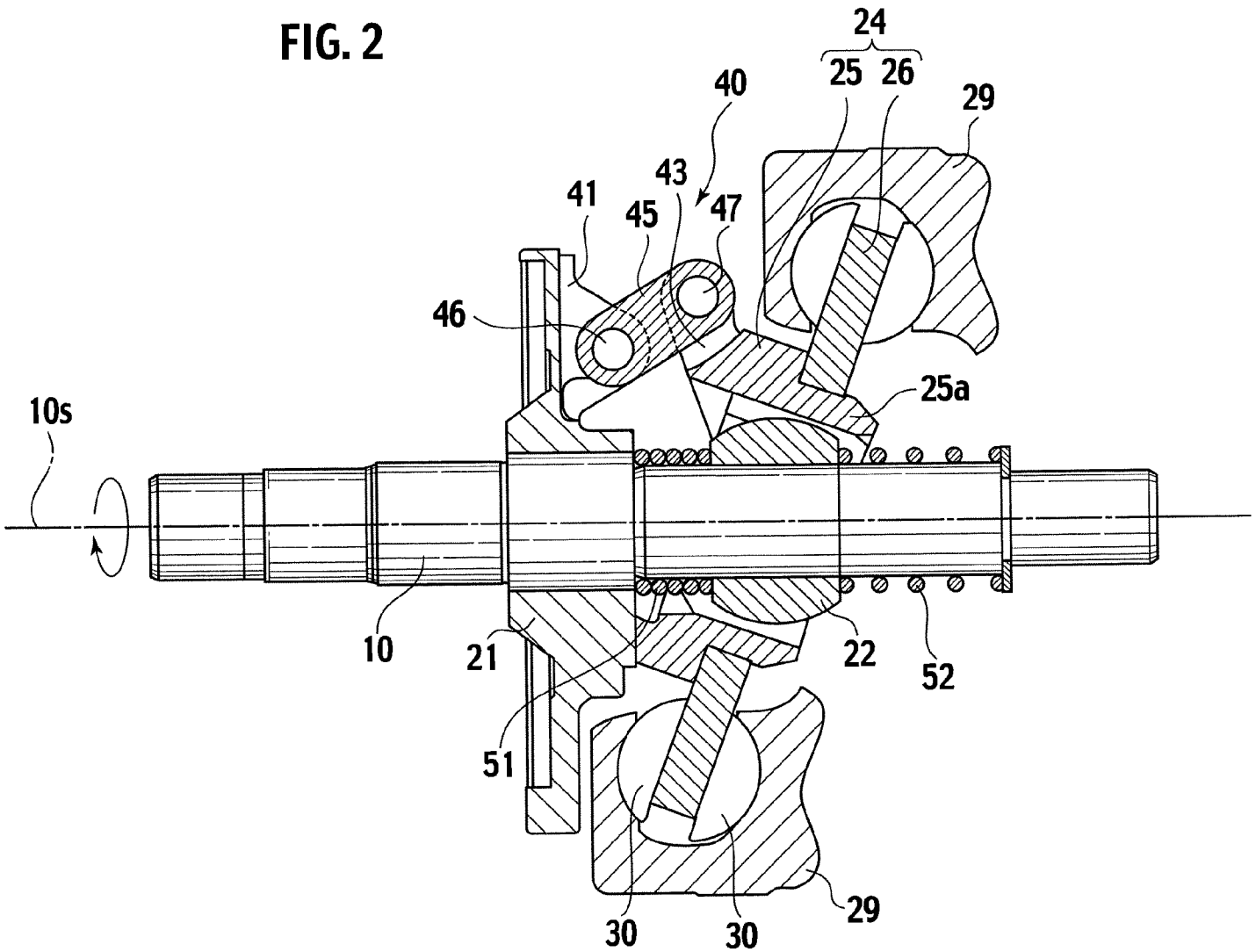
FIG. 2 is a schematic sectional view showing an assembly of a drive shaft, a rotor and a swash plate of the variable capacity compressor.
Figure 3:
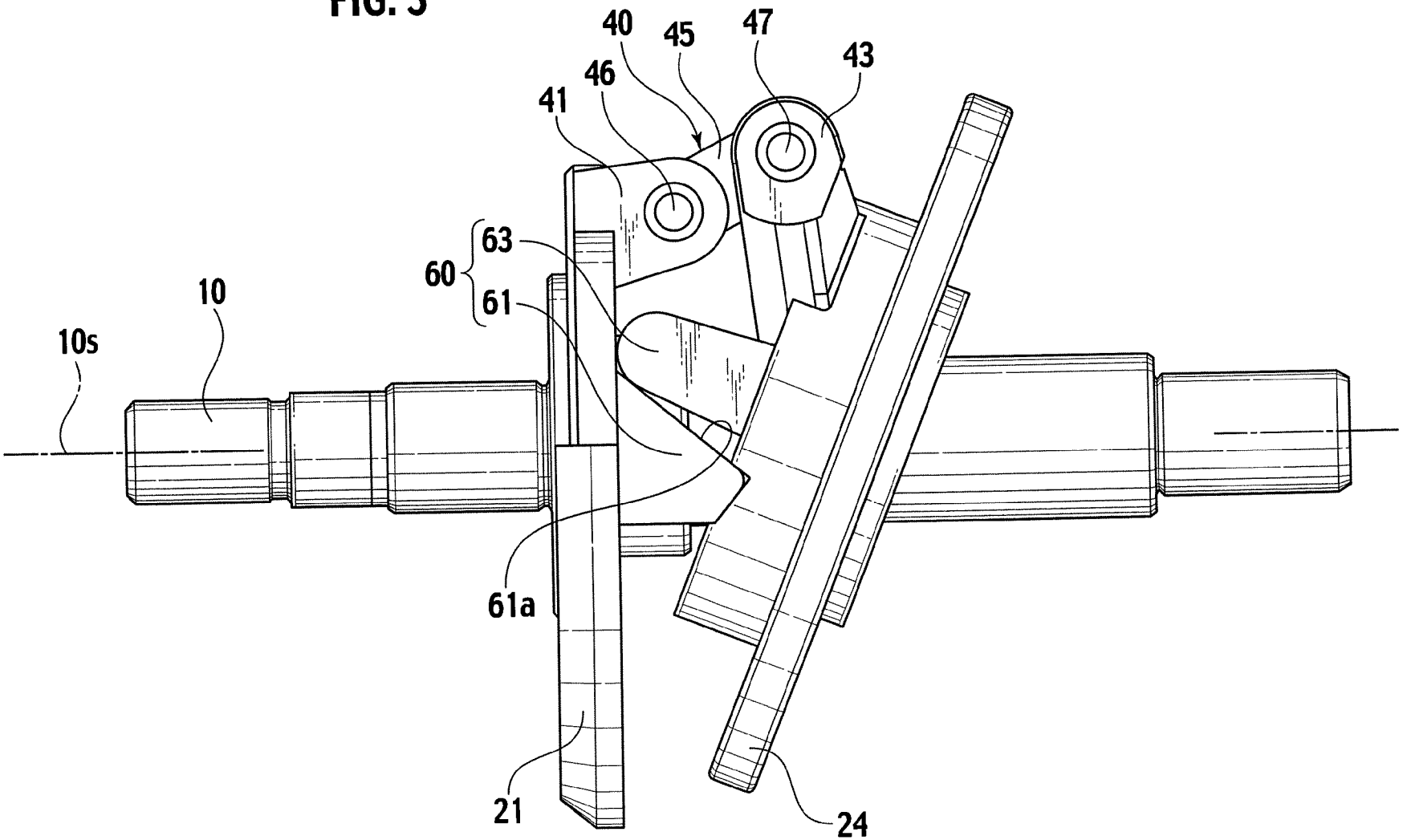
FIG. 3 is a side view showing the assembly in which the inclination angle of the swash plate is at a maximum degree.
Figure 4:
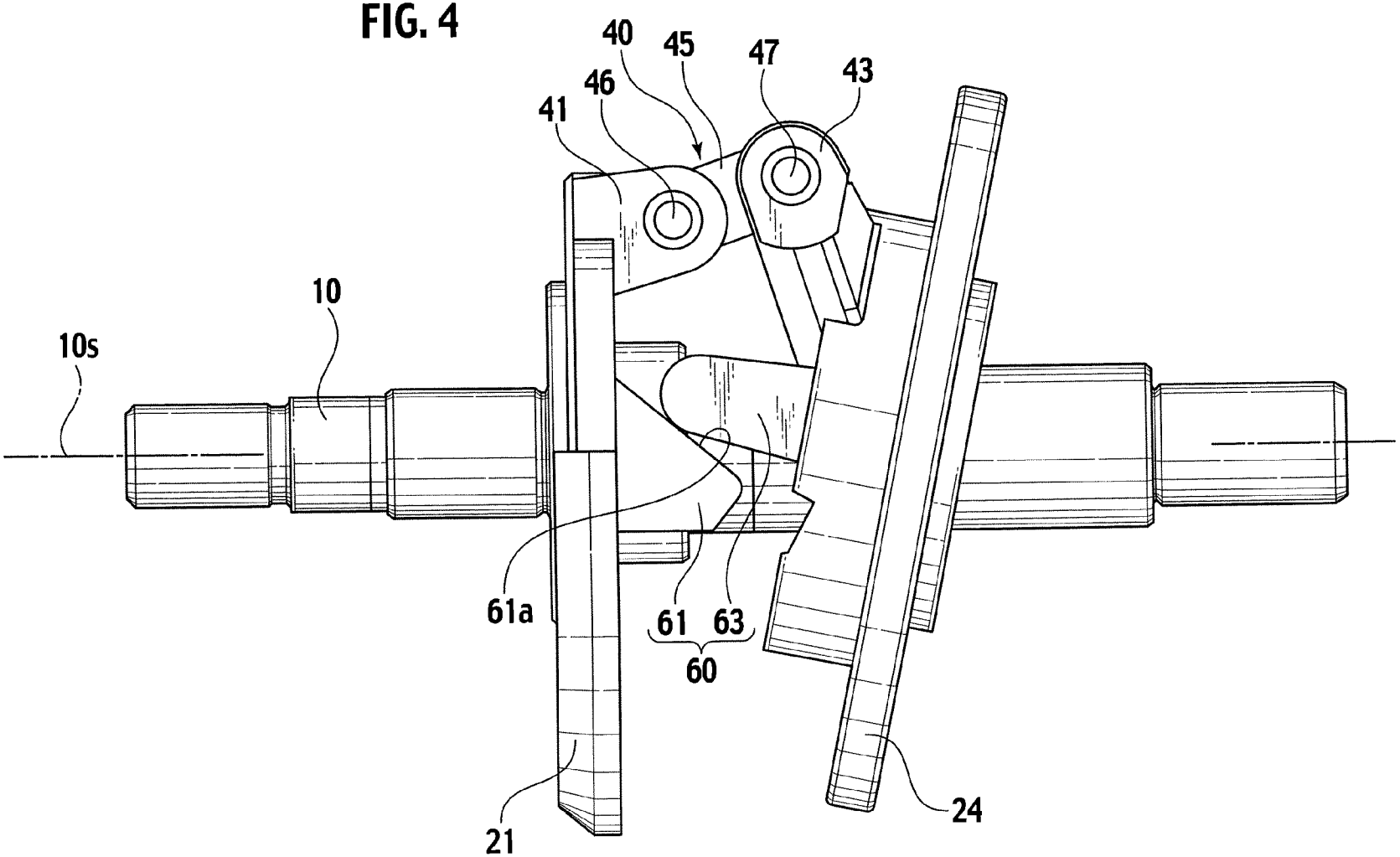
FIG. 4 is a side view showing the assembly in which the inclination angle of the swash plate is at an medium degree.
Figure 5:
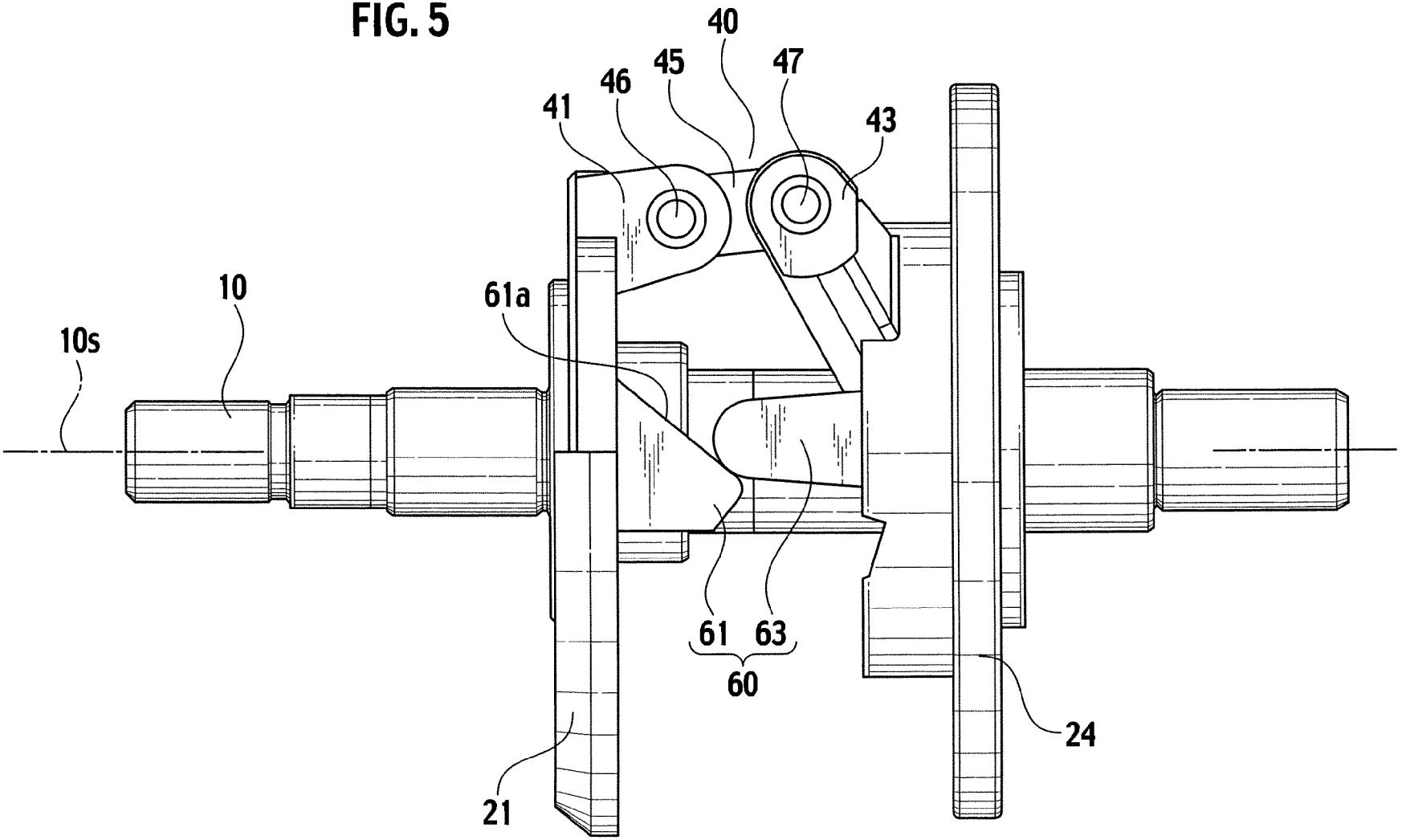
FIG. 5 is a side view showing the assembly in which the inclination angle of the swash plate is at a minimum degree.

An outline of the variable capacity compressor of the present embodiment will be described with reference to FIGS. 1 to 5. FIG. 1 is an overall view showing the variable capacity compressor with cross sections; FIG. 2 is a schematic sectional view showing an assembly of a drive shaft, a rotor and a swash plate of the variable capacity compressor; FIG. 3 is a side view showing the swash plate in the assembly, which is tilted at a maximum degree; FIG. 4 is a side view showing the swash plate in the assembly, which is tilted at a medium degree and FIG. 5 is a side view showing the swash plate in the assembly, which is tilted at a minimum degree.

As shown in FIG. 1, the variable capacity compressor 1 has a cylinder block 2 having a plurality of cylinder bores 3 placed evenly spaced apart in a circumferential direction, a front housing 4 attached to a front end of the cylinder block 2 and having a crank chamber 5 therein, and a rear housing 6 attached to a rear end of the cylinder block 2 via a valve plate 9 and having a suction chamber 7 and a discharge chamber 8 therein. The cylinder block 2, the front housing 4 and the rear housing 6 are fixedly connected to one another using plural bolts.

The valve plate 9 is formed with suction ports 11 that communicate the cylinder bores 3 with the suction chamber 7, and a discharge ports 12 that communicate the cylinder bores 3 with the discharge chamber 8.

The valve plate 9 has a valve system (not shown), on its face on the cylinder block 2 side, for opening and closing the suction ports 11 and another valve system (not shown), on its face on the rear housing 6 side, for opening and closing the discharge ports 12.

A drive shaft 10 is supported by bearings 17, 18 in support bores 19, 20 that are formed at central portions of the cylinder block 2 and the front housing 4 so that the drive shaft 10 is rotatable in the crank chamber 5.

The crank chamber 5 accommodates a rotor 21 that is a rotating member fixed to the drive shaft 10 and a swash plate 24 that is a tilting member slidably attached to the drive shaft 10. The swash plate 24 is attached to the drive shaft 10 by inserting the drive shaft through a through hole formed in the center of the swash plate 24 so that the swash plate 24 is slidable along the axis of the drive shaft 10 and tiltable with respect to the axis. The swash plate 24 of the present embodiment has a tubular hub 25 and a disk shaped swash plate body 26 fixed to the tubular hub 25, as shown in FIG. 2.

A pistons 29 is slidably contained in the cylinder bore 3 and engaged with the periphery of the swash plate 24 via a pair of hemispherical-shaped piston shoes 30, 30.

Between the rotor 21 as a rotating member and the swash plate 24 as a tilting member, a linkage mechanism 40 is interposed. The linkage mechanism 40 transfers rotary torque of the rotor 21 to the swash plate 24.

When the drive shaft 10 rotates, the rotor 21 rotates together with the drive shaft 10 and the rotation of the rotor 21 is transferred to the swash plate 24 via the linkage mechanism 40. The rotation of the swash plate 24 is converted into a reciprocating movement of the pistons 29 so that the pistons 29 reciprocate in the cylinder bores 3. By the reciprocating movements of the pistons 29, refrigerant is introduced from the suction chamber 7 into the cylinder bores 3 through the suction ports 11 of the valve plate 9, compressed in the cylinder bores 3, and discharged to the discharge chamber 8 through the discharge ports 12 of the valve plate 9.

As shown in FIGS. 3 to 5, the linkage mechanism 40 guides the inclination angle of the swash plate 24 as transferring the rotation of the rotor 21 to the swash plate 24 as described above. The inclination angle of the swash plate 24 changed by the guide of the linkage mechanism 40 increases when a sleeve 22 moves away from the cylinder block 2 against a return spring 51 (see FIG. 3) and reduces when the sleeve 22 moves closer to the cylinder block 2 (see FIG. 5). For example, as shown in FIG. 3, when the drive shaft 10 rotates with a maximum inclination angle of the swash plate 24, the pistons 29 perform maximum stroke and the discharging amount of the compressor 1 increases. On the other hand, as shown in FIG. 5, when the drive shaft 10 rotates with a minimum inclination angle of the swash plate 24, the pistons 29 perform minimum stroke and the discharging amount of the compressor reduces. As described above, the piston strokes of the pistons 29 are changed by changing the inclination angle of the swash plate 24 in order to change the refrigerant discharging amount of the compressor. According to the present embodiment, the stroke of the pistons is largest when the inclination angle of the swash plate 24 with respect to a plane orthogonal to the drive shaft 10 is about 45 degrees, and smallest when the inclination angle of the swash plate 24 is 0 degree. Further, according to the present embodiment, the swash plate 24 is biased by return springs 51, 52 toward the axial direction along the drive shaft 10 via the sleeve 22 and, when the rotation stops, the inclination angle of the swash plate 24 is stabilized at a position where the forces of the return springs 51, 52 are balanced. In this example, when the rotation stops, the swash plate 24 is stabilized at an intermediate position between the maximum inclination angle (FIG. 3) and the minimum inclination angle (FIG. 5), as a default position.

Control of Discharging Amount

The variable capacity compressor 1 is provided with a pressure control mechanism in order to control discharging amount. The pressure control mechanism controls a pressure difference (pressure balance) between the crank chamber pressure Pc in back of the piston 29 and the suction chamber pressure Ps in front of the piston 29 so as to change the inclination angle of the swash plate 24. The pressure control mechanism includes an extraction passage (not shown) that connects and communicates the crank chamber 5 with the suction chamber 7, a supply passage (not shown) that connects and communicates the crank chamber 5 with the discharge chamber 8, and a control valve 33 that is provided in the midstream of the supply passage to open and close the supply passage.

When the control valve 33 opens the supply passage, the refrigerant flows from the discharge chamber 8 into the crank chamber 5 through the supply passage, and this increases the crank chamber pressure Pc. When the crank chamber pressure Pc increases, the inclination angle of the swash plate 24 with respect to the orthogonal plane of the drive shaft 10 decreases according to the pressure balance between the crank chamber pressure Pc and the suction chamber pressure Ps. As a result, the piston stroke becomes smaller and the discharging amount decreases. On the other hand, when the control valve 33 closes the supply passage, the refrigerant is gradually extracted from the crank chamber 5 to the suction chamber 7 through the extraction passage, and this causes a reduction in the crank chamber pressure Pc. When the crank chamber pressure Pc reduces, the inclination angle of the swash plate 24 increases according to the pressure balance between the crank chamber pressure Pc and the suction chamber pressure Ps. As a result, the piston strokes become longer and the discharging amount increase.

Linkage Structure

According to the present embodiment, the rotor 21 and the swash plate 24 are linked by a tilting movement guide 60 and a rotation transfer support 70 in addition to the linkage mechanism 40. The linkage structure of the rotor 21 and the swash plate 24 will be described with reference to FIGS. 6 to 14.

Figure 6:
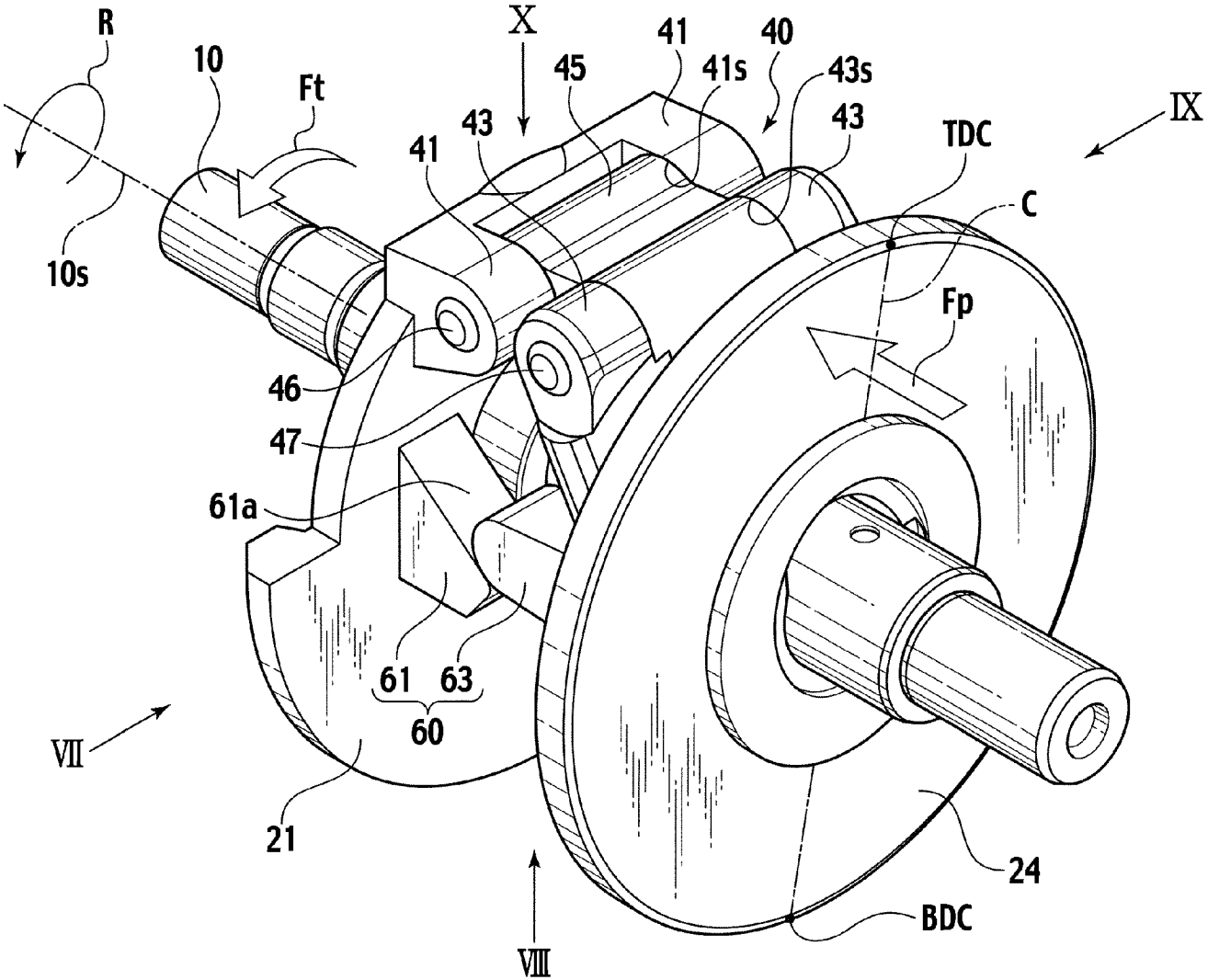
FIG. 6 is a perspective view showing the assembly.
Figure 7:
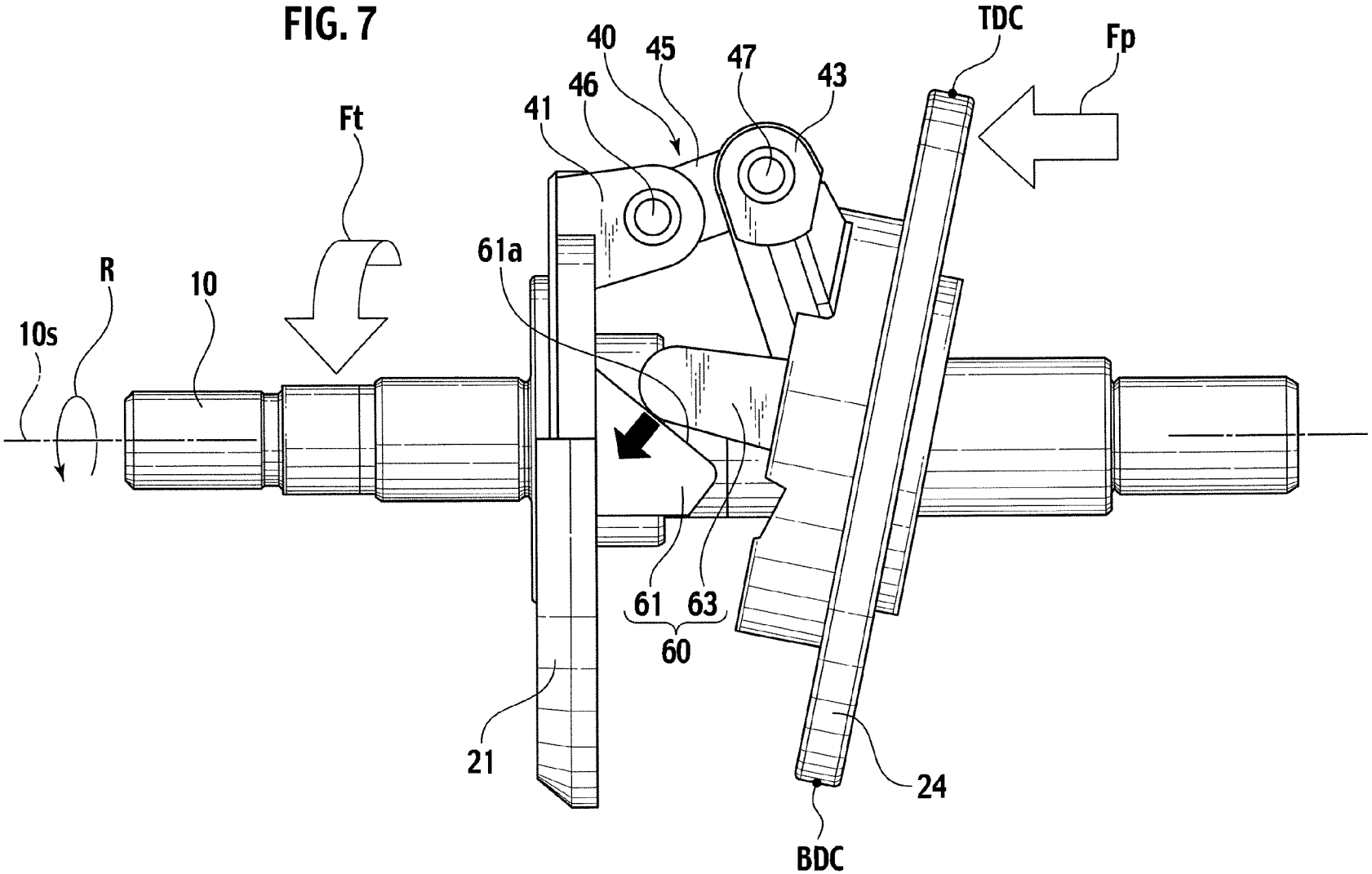
FIG. 7 is a side view seen from the arrow VII in FIG. 6.
Figure 8:
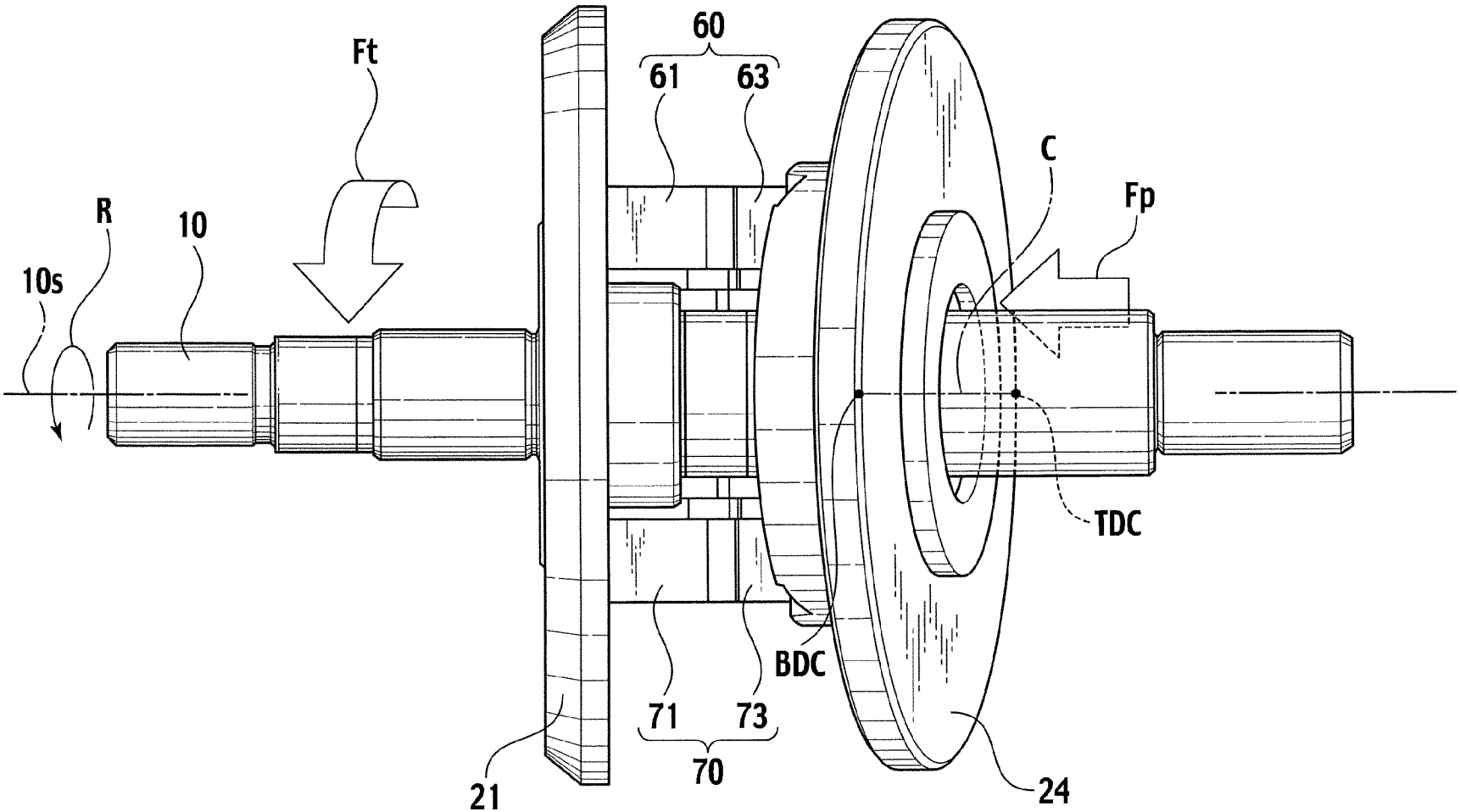
FIG. 8 is a side view seen from the arrow VIII in FIG. 6.
Figure 9:
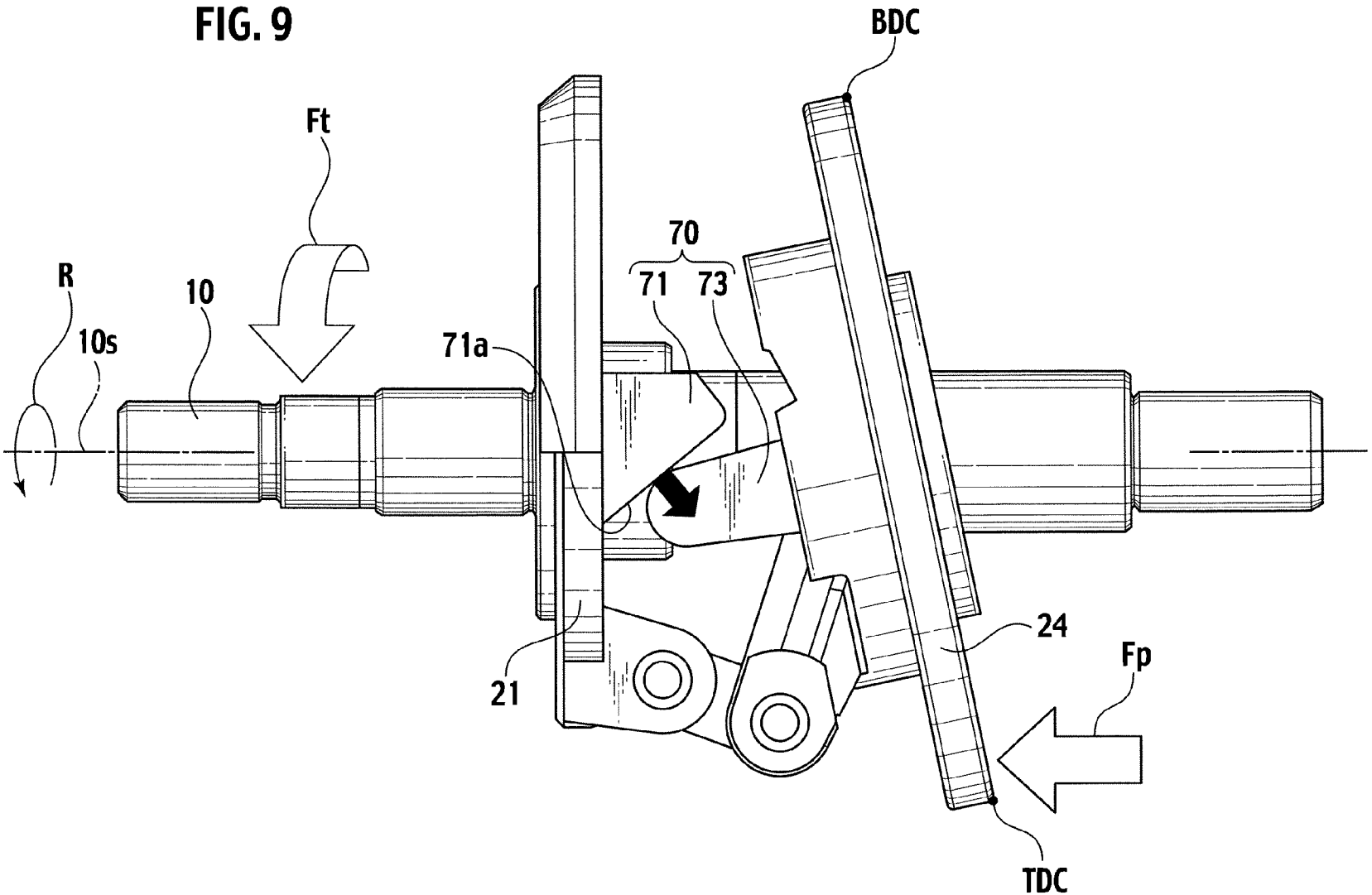
FIG. 9 is a side view seen from the arrow IX in FIG. 6.
Figure 10:
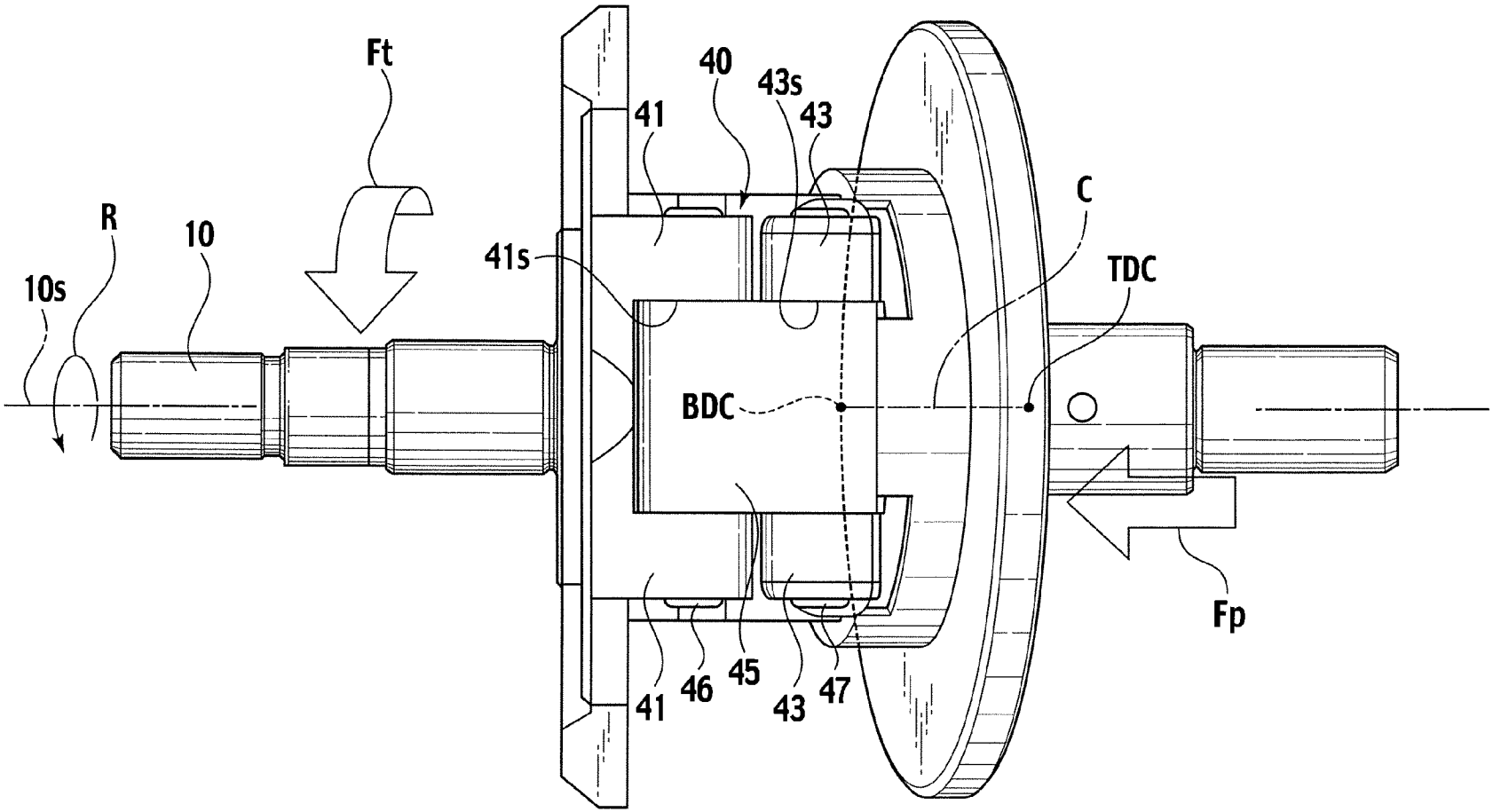
FIG. 10 is a side view seen from the arrow X in FIG. 6.
Figure 11:
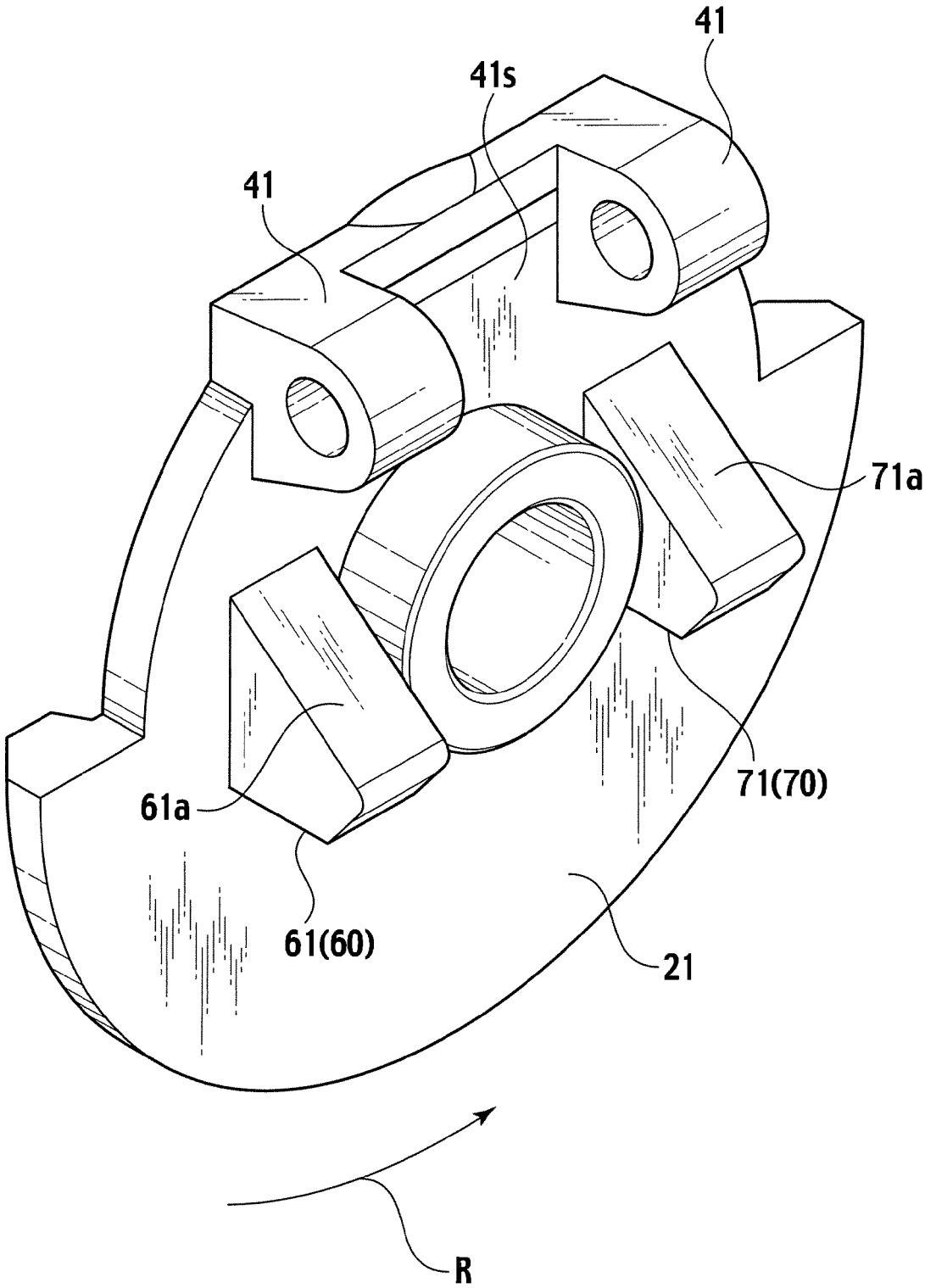
FIG. 11 is a perspective view showing the rotor of the variable capacity compressor.
Figure 12:
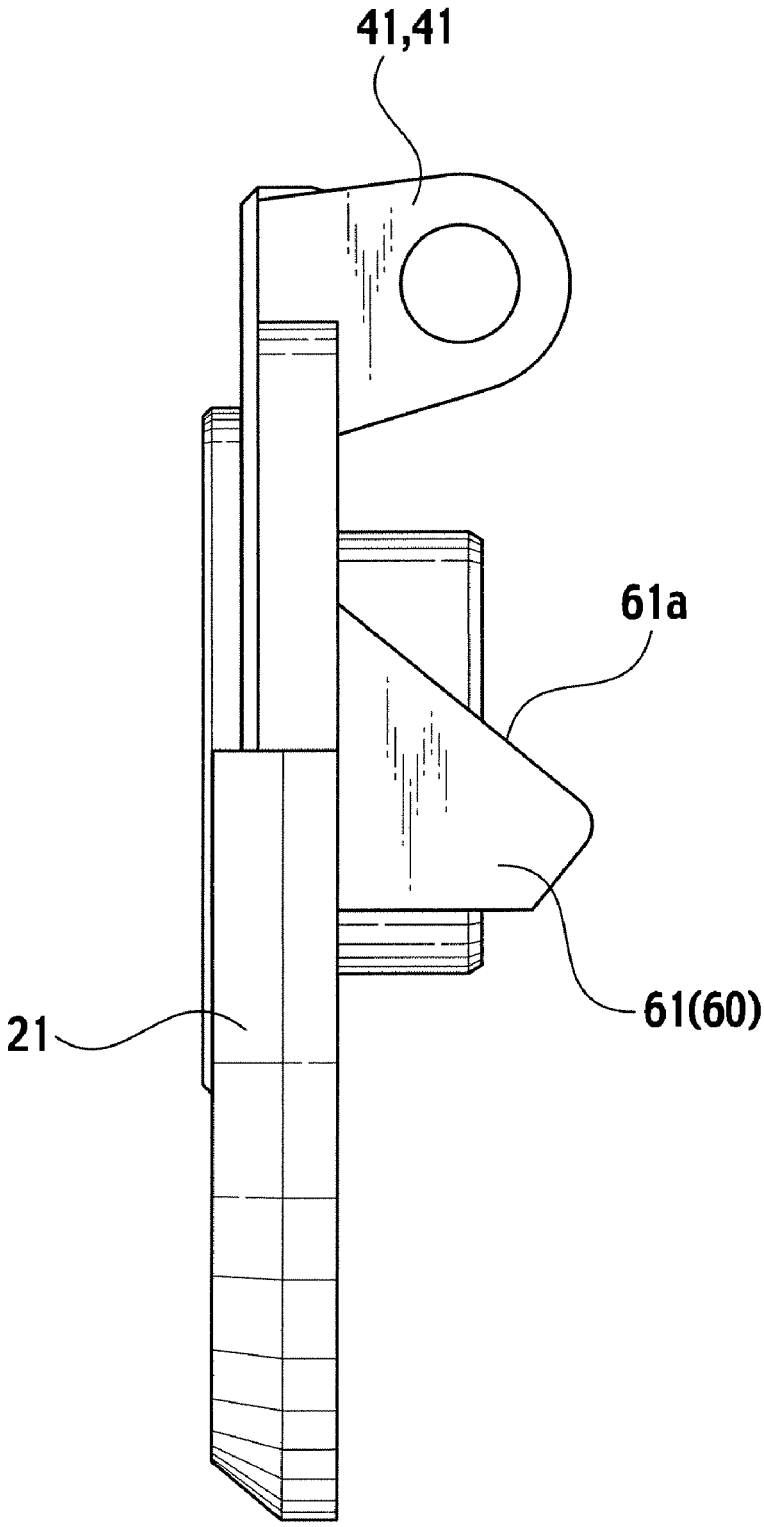
FIG. 12 is a side view showing the rotor of the variable capacity compressor.
Figure 13:
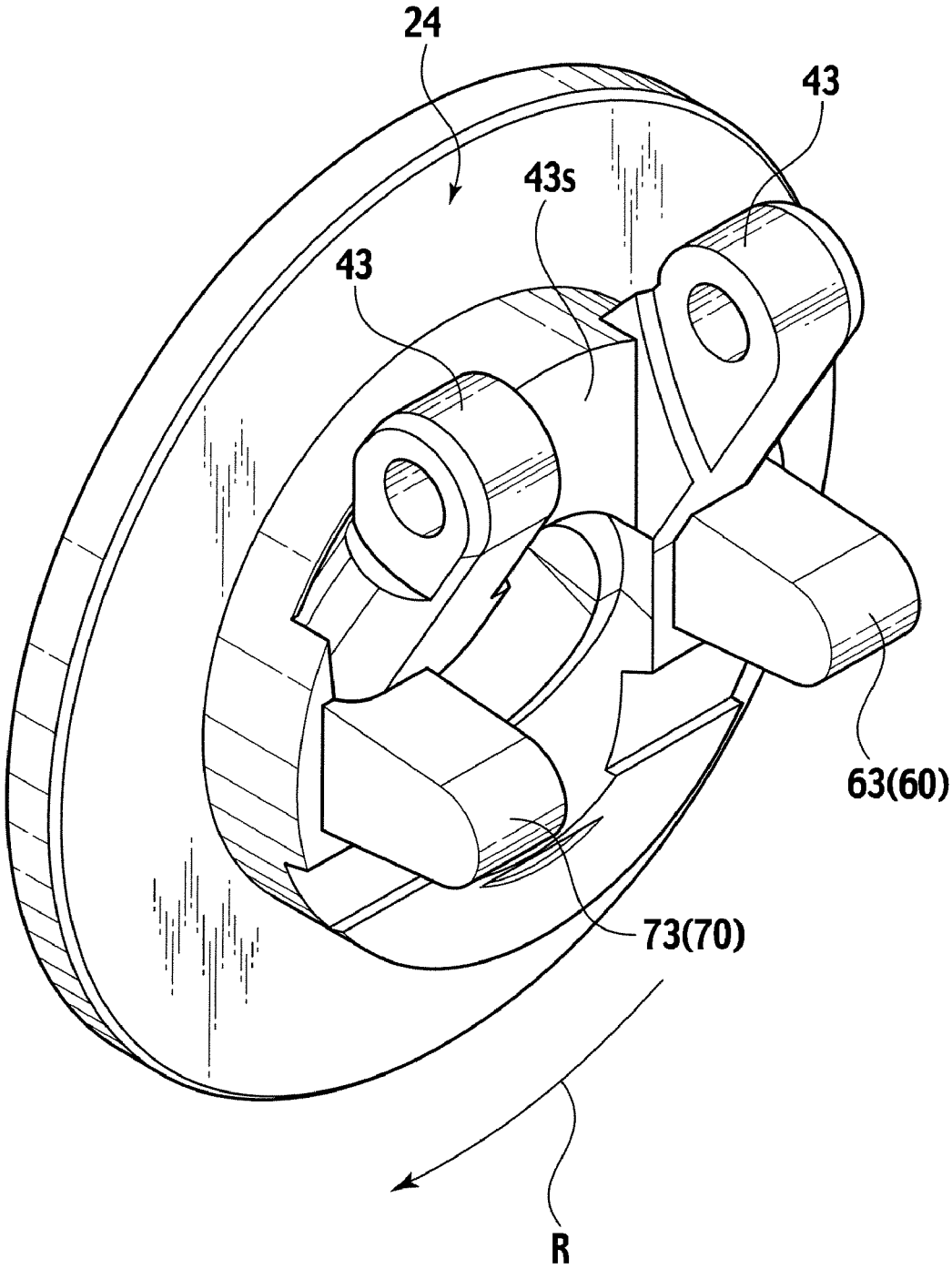
FIG. 13 is a perspective view showing the swash plate of the variable capacity compressor.
Figure 14:
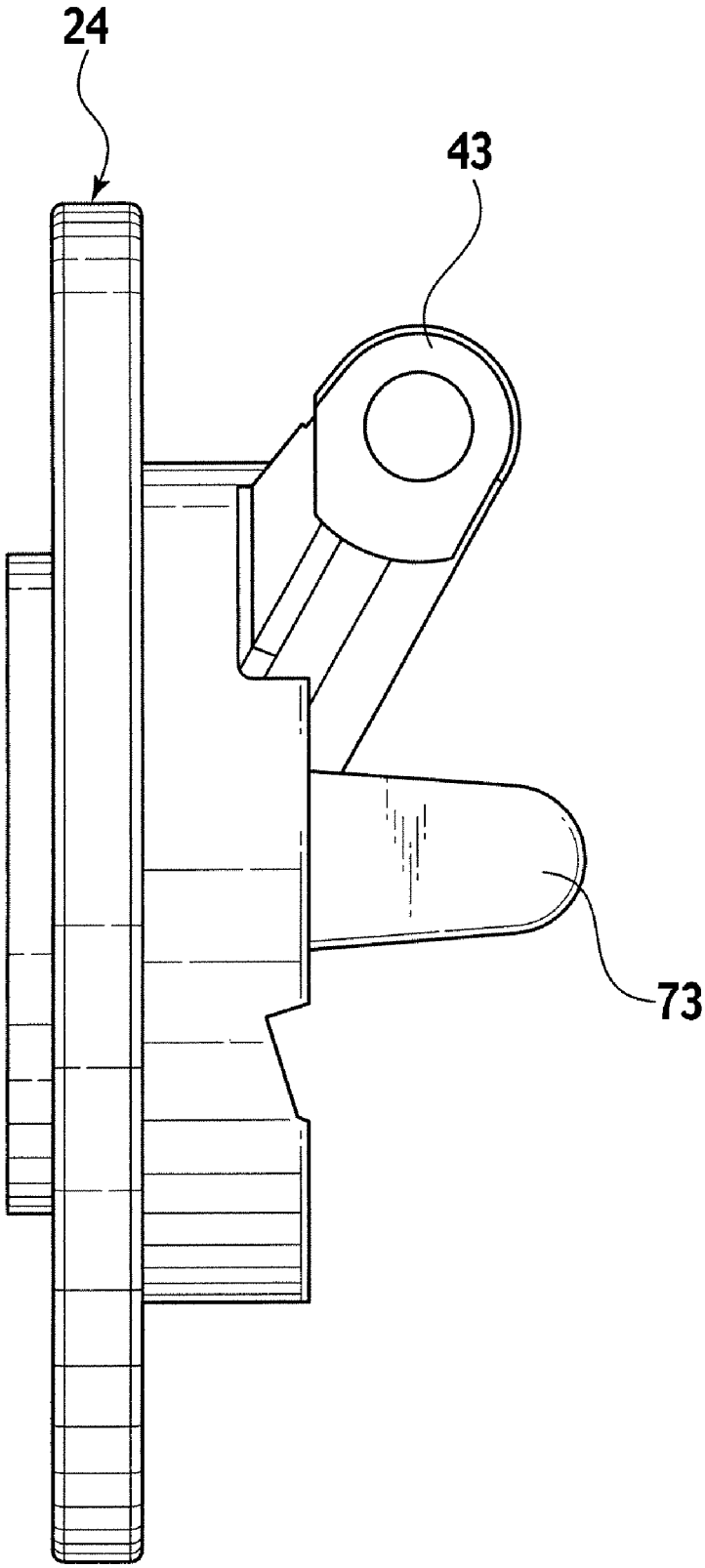
FIG. 14 is a side view showing the swash plate of the variable capacity compressor.

FIG. 6 is a perspective view showing the assembly of the drive shaft 10, the rotor 21 and the swash plate 24 of the variable capacity compressor 1; FIG. 7 is a side view seen from the arrow VII in FIG. 6; FIG. 8 is a side view seen from the arrow VIII in FIG. 6; FIG. 9 is a side view seen from the arrow IX in FIG. 6; FIG. 10 is a side view seen from the arrow X in FIG. 6; FIG. 11 is a perspective view showing the rotor; FIG. 12 is a side view showing the rotor; FIG. 13 is a perspective view showing the swash plate; and FIG. 14 is a side view showing the swash plate.

Linkage Mechanism

The linkage mechanism 40 will be described with reference to FIG. 6.

The linkage mechanism 40 has an arm 41 extending from the rotor 21 toward the swash plate 24 and an arm 43 extending from the swash plate 24 toward the rotor 21. The arm 41 of the rotor has a slit 41*s* extending in the axial direction (a direction orthogonal to the rotating direction R) and is formed in a forked shape and the arm 43 of the swash plate also has a slit 43*s* extending in the axial direction (a direction orthogonal to the rotating direction R) and formed in a forked shape. An intermediate link 45 is slidably fit in the slits 41*s*, 43*s* and sandwiched between the arms 41, 43, respectively. With such a sandwich structure along the rotating direction R, the rotation of the rotor 21 is transferred to the swash plate 24.

An end of the intermediate link 45 and the arm 41 of the rotor is linked using a first hinge pin 46. Further, another end of the intermediate link 45 and the arm 43 of the swash plate are linked using a second hinge pin 47. With such a hinge structure of the hinge pins 46, 47, the tilting movement of the swash plate 24 is guided as shown in FIGS. 4 to 6.

With this linkage mechanism 40, the position of the linkage mechanism 40 corresponds to an upper dead center TDC of the swash plate 24, and the area opposite to the linkage mechanism 40 across the drive shaft 10 corresponds to a lower dead center BDC of the swash plate 24.

When the compressor 1 is in operation, the linkage mechanism 40 transfers the rotary torque Ft from the rotor 21 to the swash plate 24 and receives an axial direction load transferred from the swash plate 24 to the rotor 21, which is generated by the compression reaction force Fp from the pistons 29. Further, since the maximum compression reaction force Fp is applied not to an area corresponding to the linkage mechanism 40 but to an area forwardly shifted from the linkage mechanism 40 in the rotating direction R, this shifting generates a torsion moment to the linkage mechanism 40.

According to the present embodiment, the rotary torque Ft, axial direction load and torsion moment applied to the linkage mechanism 40 are reduced by means of a tilting movement guide 60 and a rotation transfer support 70, so that the inclination angle of the swash plate 24 can be smoothly changed. The tilting movement guide 60 and the rotation transfer support 70 will be described with reference to FIGS. 7 to 14.

Tilting Movement Guide and Rotation Transfer Support

The tilting movement guide 60 is provided anterior to the linkage mechanism 40 in the rotating direction R and on the lower dead center BDC side as seen from the linkage mechanism 40, separately from the linkage mechanism 40. The rotation transfer support 70 is provided behind the linkage mechanism 40 in the rotating direction R and on the lower dead center BDC side as seen from the linkage mechanism 40, separately from the linkage mechanism 40.

The tilting movement guide 60 and the rotation transfer support 70 are located substantially intermediate between the upper dead center TDC and the lower dead center BDC in the rotating direction of the rotor 21. The tilting movement guide 60 and the rotation transfer support 70 are placed opposite to each other across the drive shaft 10 and formed in a mirror symmetry manner.

The tilting movement guide 60 has projections 61, 63 serving as contact portions that are respectively formed at the rotor 21 and the swash plate 24 and contact with each other. The rotation transfer support 70 also has projections 71, 73 serving as contact portions that are respectively formed at the rotor 21 and the swash plate 24 and contact with each other.

The respective of tilting movement guide 60 and the rotation transfer support 70 have inclined faces 61*a*, 71*a* on the projections 61, 71 that are projected from the rotor 21. The inclined faces 61*a*, 71*a* are formed along movement locus of fore-ends of the projections 63, 73 that are projected from the swash plate 24. With this configuration, when the inclination angle of the swash plate 24 is changed by the guide of the linkage mechanism 40, the projections 63, 73 of the swash plate 24 always slidably contact with the inclined face 61*a*, 71*a* of the projections 61, 71 of the rotor in any inclination angle of the swash plate 24 (see FIGS. 3 to 5). Here, both of the inclined faces 61*a*, 71*a* face in direction on the upper dead center TDC side. With such a configuration, the tilting movement guide 60 and the rotation transfer support 70 guide changes of the inclination angle of the swash plate 24 as supporting the tilting movement guide of the linkage mechanism 40. More concretely, the tilting movement guide 60 and the rotation transfer support 70 support the tilting guide of the linkage mechanism 40 to disperse the axial direction load applied to the linkage mechanism 40 regardless of the inclination angle of the swash plate 24.

Further, regarding the rotation transfer support 70, since the projection 71 of the rotor is located behind of the projection 73 of the swash plate in the rotating direction R, the rotation transfer support 70 has a rotation transfer supporting function for transferring the rotary torque of the rotor 21 to the swash plate 24. Thus, the rotation transfer support 70 bears part of the rotary torque transfer, which was served only by the linkage mechanism 40 in a conventional configuration, so that the rotary torque applied to the linkage mechanism 40 is reduced (see FIG. 9).

On the other hand, regarding the tilting movement guide 60, since the projection 61 of the rotor is located anterior to the projections 63 of the swash plate in the rotating direction R, the tilting movement guide 60 does not have a function for transferring the rotary torque of the rotor 21 to the swash plate 24. The tilting movement guide 60, however, is located anterior to the linkage mechanism 40, which is in upper dead center, in the rotating direction R, and receives the maximum compression reaction force Fp applied to an area in front of the linkage mechanism 40 in the rotating direction R. With this configuration, the torsion moment which was applied to the linkage mechanism 40 in a conventional configuration can be reduced (see FIG. 7).

As described above, according to the present embodiment, the rotary torque and torsion moment applied to the linkage mechanism 40 is reduced by means of the tilting movement guide 60 and rotation transfer support 70. Therefore the load of the linkage mechanism 40 is reduced and a wedge state in the linkage mechanism 40 due to an excessive pressure is prevented so that the inclination angle of the swash plate 24 can be smoothly changed.

Figure 15:
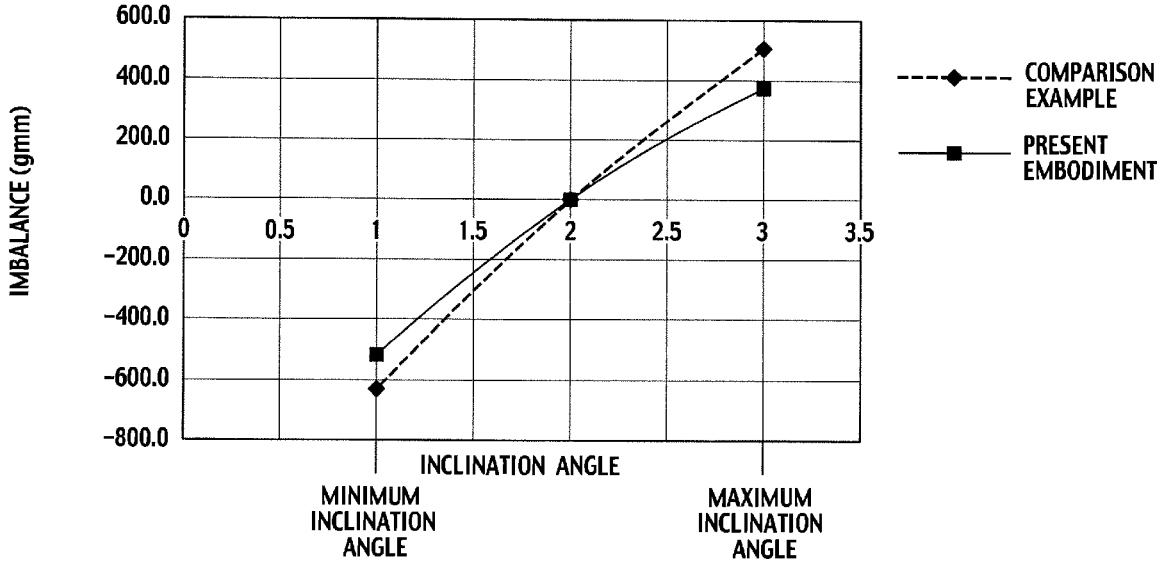
FIG. 15 is a graph showing an eccentricity of barycenter position of the assembly with respect to the axis of the drive shaft and comparing the present embodiment with a comparative example which does not have a tilting movement guide and a rotation transfer support.

Further, according to the present embodiment, since the tilting movement guide 60 and rotation transfer support 70 are provided in addition to the linkage mechanism 40, well weight-balanced structure can be obtained than the configuration without the tilting movement guide 60 and rotation transfer support 70. FIG. 15 is a graph showing an eccentricity of gravity center of the assembly with respect to an axis 10*s* of the drive shaft 10. In this graph, the continuous line represents results of the assembly of the present embodiment and the dotted line represents results of an assembly in which the tilting movement guide 60 and rotation transfer support 70 are removed from the present embodiment. FIG. 15 shows that the gravity center of the assembly of the present embodiment is kept close to the axis 10*s* of the drive shaft 10 even when the inclination angle of the swash plate 24 is changed and this indicates that weight balance has been improved.

Effect

Effects of the present embodiment will be listed below.

(1) The variable capacity compressor 1 according to the present embodiment has a rotor 21, as a rotating member, fixed to a drive shaft 10 and rotating integrally with the drive shaft 10, a swash plate 24, as a tilting member, tiltably and slidably attached to the drive shaft 10, a linkage mechanism 40 linking the rotor 21 and the swash plate 24 at a position corresponding to an upper dead center TDC of the swash plate 24, and having a sandwich structure along a rotating direction to transfer rotation of the rotor 21 to the swash plate 24 and guide the tilting movement of the swash plate 24, and a tilting movement guide 60 provided between the rotor 21 and the swash plate 24 and anterior to the linkage mechanism 40 in the rotating direction and guiding changes of the inclination angle of the swash plate 24 with respect to the drive shaft 10.

Thus, the tilting movement guide 60 provided anterior to the linkage mechanism 40 in the rotating direction R can receive axial direction load Fp applied to the swash plate 24. In other words, the tilting movement guide 60 can receive biased compression reaction force Fp when the compression reaction force Fp is applied biased anterior to the position corresponding to the upper dead center TDC, where the linkage mechanism 40 is located, in the rotating direction R. This configuration reduces torsion moment applied to the linkage mechanism 40 and prevents a wedge state in the linkage mechanism 40 due to an excessive pressure. Thus the inclination angle of the swash plate 24 can be smoothly changed and the controllability is improved. Further, a longer operating life of the linkage mechanism 40 is obtained.

(2) In the variable capacity compressor 1 of the present embodiment, the tilting movement guide 60 is provided closer to a lower dead center BDC, than the linkage mechanism 40.

Since the tilting movement guide 60 is provided closer to the lower dead center BDC, than the linkage mechanism 40, the gravity center which tends to biased toward upper dead center TDC can be shifted close to the lower dead center BDC and this provides an improved balance of the rotor 21 and swash plate 24.

(3) In the variable capacity compressor 1 of the present embodiment, the tilting movement guide 60 is placed substantially intermediate between the upper dead center TDC and the lower dead center BDC. This provides a further improved weight balance.

(4) In the variable capacity compressor 1 of the present embodiment, the tilting movement guide 60 is contact portions 61, 63 respectively formed at the rotor 21 and the swash plate 24 and contact with each other. This provides a tilting movement guide having a simple structure.

(5) The variable capacity compressor 1 of the present embodiment further includes a rotation transfer support 70 provided between the rotor 21 and the swash plate 24 and transferring rotation of the rotor 21 to the swash plate 24. This reduces rotary torque transferred by the linkage mechanism 40. With this configuration, the inclination angle of the swash plate 24 can smoothly changed and the controllability is improved. Further, a longer operating life of the linkage mechanism 40 can be obtained.

(6) The variable capacity compressor 1 of the present embodiment further includes rotation transfer support 70 provided between the rotor 21 and the swash plate 24 and behind the linkage mechanism 40 in a rotating direction R, and guiding changes of inclination angle of the swash plate 24.

In other words, the rotation transfer support 70 is provided behind the linkage mechanism 40 in the rotating direction R between the rotor 21 and the swash plate 24 and guides the inclination angle of the swash plate 24 so that the rotation transfer support 70 also has a function for transferring the rotation of the rotor 21 to the swash plate 24. This reduces rotary torque transferred by the linkage mechanism 40. Further, since the rotation transfer support 70 is placed behind the linkage mechanism 40 in the rotating direction R, the weight balance with the tilting movement guide 60 that is provided anterior to the linkage mechanism 40 in the rotating direction R is improved. This configuration provides well weight-balanced rotor 21 and swash plate 24.

The tilting movement guide 60, linkage mechanism 40, and rotation transfer support 70 form a triangle around the drive shaft 10. In other words, the tilting movement guide 60, linkage mechanism 40 and rotation transfer support 70 support the swash plate 24 against the rotor 21 at those three positions, the supporting condition of the swash plate 24 is secured.

(7) In the variable capacity compressor 1 of the present embodiment, the rotation transfer support 70 is placed substantially intermediate between the upper dead center TDC and the lower dead center BDC. This provides further well weight-balanced rotor 21 and swash plate 24.

(8) In the variable capacity compressor 1 of the present embodiment, the tilting movement guide 60 and the rotation transfer support 70 are placed opposite to each other across the drive shaft 10. This provides further well weight-balanced rotor 21 and swash plate 24.

(9) In the variable capacity compressor 1 of the present embodiment, the tilting movement guide 60 and the rotation transfer support 70 are formed in a mirror symmetry manner across the drive shaft 10. This provides further well weight-balanced rotor 21 and swash plate 24. Further, since they are formed in symmetric shapes, manufacturing process can be simplified.

(10) In the variable capacity compressor 1 of the present embodiment, the rotation transfer support 70 is contact portions 71, 73 respectively formed at the rotor 21 and the swash plate 24 and contact with each other. This configuration provides a rotation transfer support 70 having simpler structure.

(11) The linkage mechanism 40 has an arm 41 extending from the rotor 21 toward the swash plate 24 and formed in a forked shape with a slit 41*s*, an arm 43 extending from the swash plate 24 toward the rotor 21 and formed in a forked shape with a slit 43*s*, an intermediate link 45 inserted in the slits 41*s*, 43*s* of the arms 41, 43 and overlapping with the arms 41, 43 in the rotating direction R, a first hinge pin 46 linking the arm 41 of the rotor 21 and the intermediate link 45, and a second hinge pin 47 linking the arm 43 of the swash plate 24 and the intermediate link 45. This configuration provides simpler linkage mechanism 40 having a sandwich structure.

The linkage mechanism 40 is not limited to what is described in the above embodiment and may include other configurations as long as it has a sandwich structure along the rotating direction R to transfer the rotation of the rotor 21 to the swash plate 24 and guide the tilting movement of the swash plate 24.

For example, the intermediate link 45 may be formed in a forked shape and the rotor 21 and/or the swash plate 24 may be sandwiched in the intermediate link 45. This configuration corresponds to what is described in Japanese Patent Application Laid-Open No. 10-176658 and No. 2003-172417, for example, Further, the linkage mechanism may include an arm extending from the rotor 21 toward the swash plate 24, an arm extending from the swash plate 24 toward the rotor 21 and overlapping with the arm of the rotor 21 in the rotating direction R, an arch-shaped long hole formed at one of the arms, and a pin fixed to the other of the arms and inserted into the long hole, wherein the arm of rotor is formed in a forked shape with a slit to slidably sandwich the arm of the swash plate, or the arm of the swash plate is formed in a forked shape with a slit to slidably sandwich the arm of the rotor.

Figure 16:
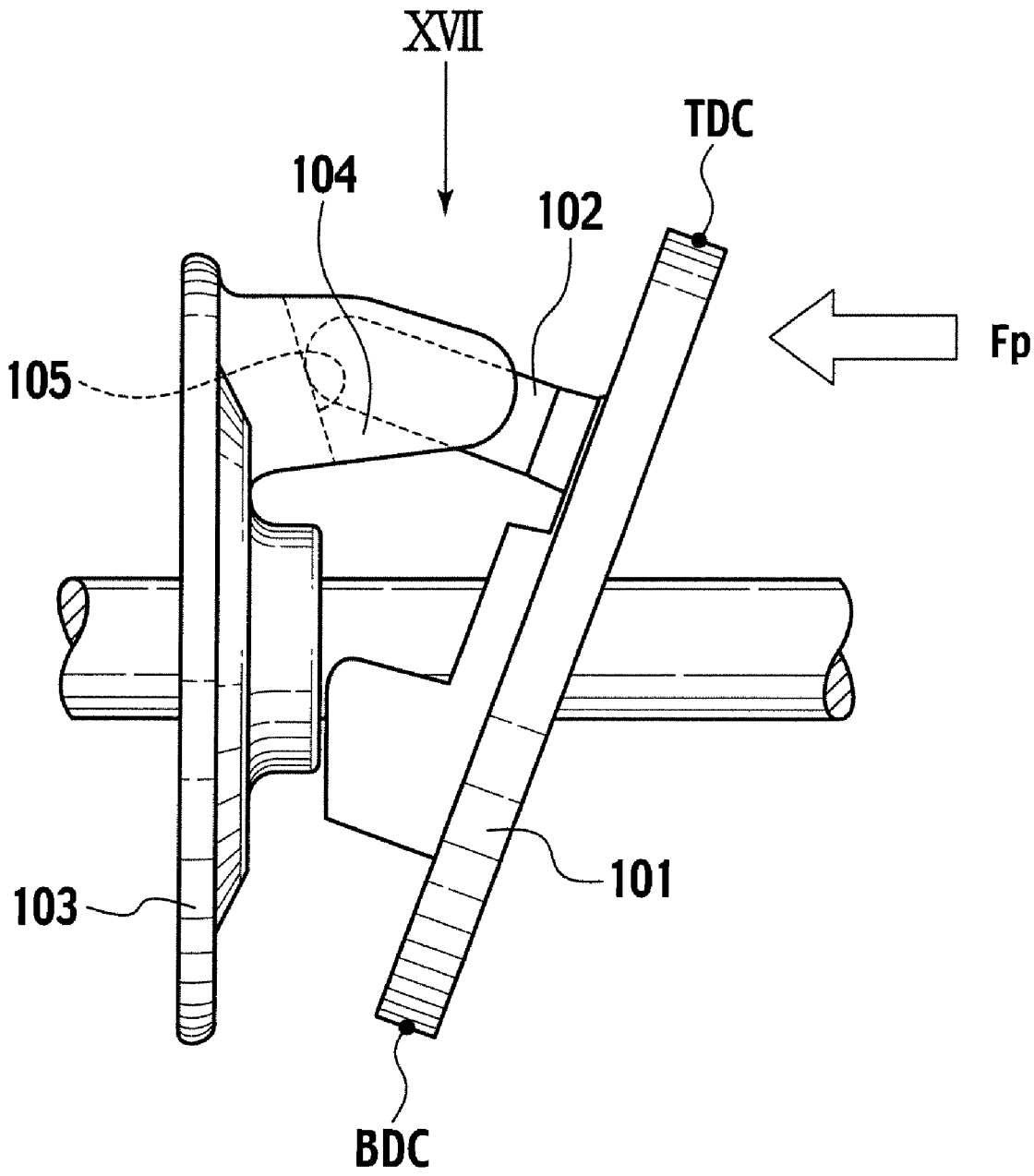
FIG. 16 is a side view showing an assembly of a drive shaft, a rotor and a swash plate of a conventional variable capacity compressor.
Figure 17:
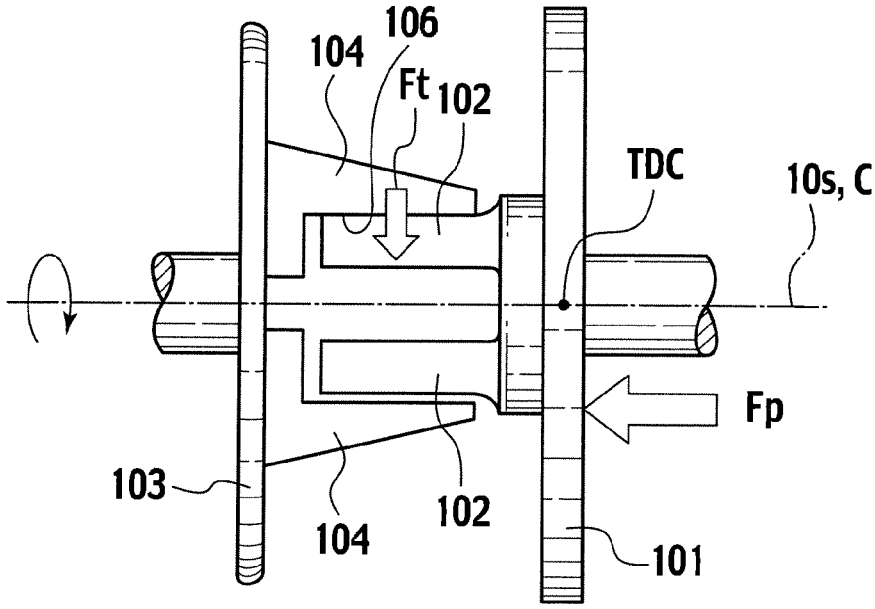
FIG. 17 is a side view seen from the arrow XVII in FIG. 16.
Figure 18:
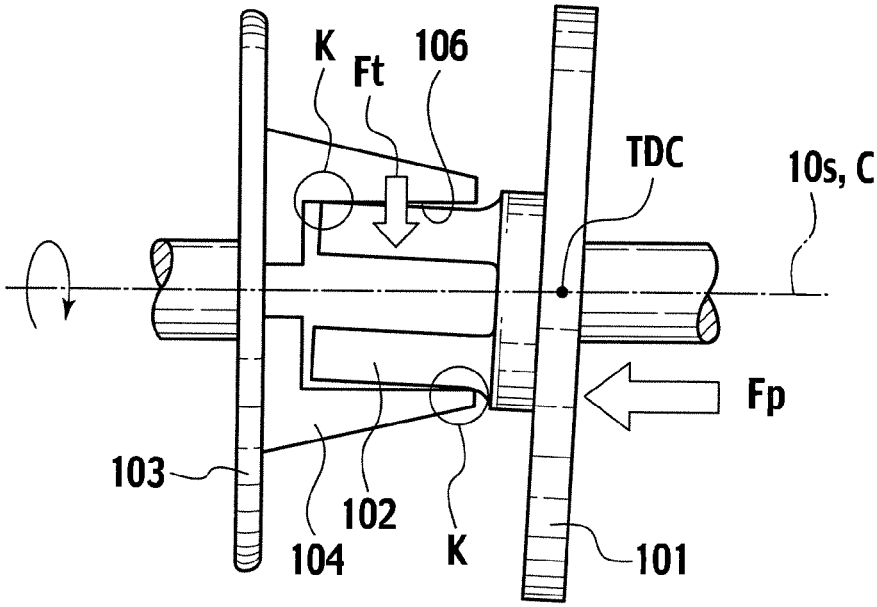
FIG. 18 is a side view of the assembly of FIG. 17, to which an excessive compression reaction force is applied.

Further, as shown in FIGS. 16 to 18, the, linkage mechanism may include an arm 104 extending from a rotor 103 toward a swash plate 101, an arm 102 extending from the swash plate 101 toward the rotor 103, and a tilting movement guide face 105, and wherein the arm 104 of the rotor is formed in a forked shape with a slit 106 to slidably sandwich the arm 102 of the swash plate or the arm 102 of the swash plate is formed in a forked shape with a slit to slidably sandwich the arm 104 of the rotor so that the arm 104 of the rotor and the arm 102 of the swash plate are overlapped in the rotating direction R, and wherein the tilting movement guide face 105 is formed at a base portion of the arm 104 of the rotor or the arm 102 of the swash plate and contacts with a fore-end of the arm 102 of the swash plate or the arm 104 of the rotor to receive axial direction load applied, to the swash plate and guide changes of inclination angle of the swash plate with respect to the drive shaft 10.

Further, the linkage mechanism may include different configuration as long as it has a sandwich structure along the rotating direction R to transfer the rotation of the rotor 21 to the swash plate 24 and guide the tilting movement of the swash plate 24.

It should be appreciated that the present invention is not limited to the above described embodiment.

For example, in the above embodiment, the swash plate 24 may be attached to the drive shaft 10 via substantially spherical shaped sleeves, or the swash plate 24 may be directly attached to the drive shaft 10 without the sleeves.

Further, although a swash-type swash plate is used in the above embodiment, a wobble-type plate can be used in the present invention. The present invention can be implemented with various modifications and changes without departing from the technical scope and characteristics of the present invention.

The invention claimed is:

1. A variable capacity compressor comprising:

a rotating member fixed to a drive shaft and rotating integrally with the drive shaft;

a tilting member tiltably attached to the drive shaft;

a linkage mechanism that links the rotating member and the tilting member at a position corresponding to an upper dead center of the tilting member, and has a sandwich structure along a rotating direction to transfer rotation of the rotating member to the tilting member and guide a tilting movement of the tilting member; and a tilting movement guide that is provided between the rotating member and the tilting member and anterior to the linkage mechanism in the rotating direction, and guides changes of an inclination angle of the tilting member with respect to the drive shaft, wherein the tilting movement guide has a rotating member projection formed at the rotating member and a tilting member projection formed at the tilting member that contacts the rotating member projection, and the tilting movement guide has an inclined face on the rotating member projection and the inclined face is formed along movement locus of a fore-end of the tilting member projection so that, while the inclination angle of the tilting member is changed with guiding by the linkage mechanism, the tilting member projection always slidably contacts the inclined face on the rotating member projection.

2. The variable capacity compressor according to claim 1, wherein the tilting movement guide is provided closer to a lower dead center of the tilting member that is on an opposite side of the linkage mechanism across the drive shaft, than the linkage mechanism.

3. The variable capacity compressor according to claim 2, wherein the tilting movement guide is placed substantially intermediate between the upper dead center and the lower dead center in the rotating direction.

4. The variable capacity compressor according to claim 1, further comprising a rotation transfer support that is provided between the rotating member and the tilting member and transfers the rotation of the rotating member to the tilting member.

5. The variable capacity compressor according to claim 1, further comprising a rotation transfer support provided between the rotating member and the tilting member and posterior to the linkage mechanism in the rotating direction, and guides changes of the inclination angle of the tilting member.

6. The variable capacity compressor according to claim 5, wherein the rotation transfer support is placed substantially intermediate between the upper dead center and the lower dead center in the rotating direction.

7. The variable capacity compressor according to claim 6, wherein the tilting movement guide and the rotation transfer support are placed opposite to each other across the drive shaft.

8. The variable capacity compressor according to claim 6, wherein the tilting movement guide and the rotation transfer support are formed in a mirror symmetry manner across the drive shaft.

9. The variable capacity compressor according to claim 4, wherein the rotation transfer support has a rotating member projection formed at the rotating member and a tilting member projection formed at the tilting member that contacts the rotating member projection, and the rotation transfer support has an inclined face on the rotating member projection and the inclined face is formed along movement locus of a fore-end of the tilting member projection so that while the inclination angle of the tilting member is changed with guiding by the linkage mechanism, the tilting member projection always slidably contacts the inclined face on the rotating member projection.

10. The variable capacity compressor according to claim 1, wherein the linkage mechanism comprises:

a rotating member arm that extends from the rotating member toward the tilting member;

a tilting member arm that extends from the tilting member toward the rotating member;

an intermediate link that overlaps with the rotating member arm and the tilting member arm in the rotating direction;

a first hinge pin that links the rotating member arm and the intermediate link; and a second hinge pin that links the tilting member arm and the intermediate link, wherein the intermediate link and the rotating member or the tilting member are overlapped in the rotating direction in the sandwich structure along the rotating direction.

11. The variable capacity compressor according to claim 1, wherein the linkage mechanism comprises:

a rotating member arm that extends from the rotating member toward the tilting member and is formed in a forked shape with a slit;

a tilting member arm that extends from the tilting member toward the rotating member and is formed in a forked shape with a slit;

an intermediate link that is inserted into the slits to be overlapped with the rotating member arm and the tilting member arm in the rotating direction;

a first hinge pin that links the rotating member arm and the intermediate link; and a second hinge pin that links the tilting member arm and the intermediate link.

12. The variable capacity compressor according to claim 1, wherein the linkage mechanism comprises:

a rotating member arm that extends from the rotating member toward the tilting member;

a tilting member arm that extends from the tilting member toward the rotating member; and a tilting movement guide face, wherein the rotating member arm is formed in a forked shape with a slit to slidably sandwich the tilting member arm or the tilting member arm is formed in a forked shape with a slit to slidably sandwich the rotating member arm so that the rotating member arm and the tilting member arm are overlapped in the rotating direction, and wherein the tilting movement guide face is formed at a base portion of the rotating member arm or the tilting member arm and contacts with a fore-end of the tilting member arm or the rotating member arm to receive axial direction load applied to the tilting member and guide changes of an inclination angle of the tilting member with respect to the drive shaft.

* * * * *